US012193556B2

(12) United States Patent
Lin

(10) Patent No.: US 12,193,556 B2
(45) Date of Patent: Jan. 14, 2025

(54) RECYCLABLE COSMETIC CONTAINER

(71) Applicant: LIBO COSMETICS CO., LTD., Taichung (TW)

(72) Inventor: Hsiao-Yun Lin, Taichung (TW)

( * ) Notice: Subject to any disclaimer, the term of this patent is extended or adjusted under 35 U.S.C. 154(b) by 377 days.

(21) Appl. No.: 17/880,680

(22) Filed: Aug. 4, 2022

(65) Prior Publication Data

US 2024/0041182 A1 Feb. 8, 2024

(51) Int. Cl.
*A45D 40/02* (2006.01)
*A45D 40/06* (2006.01)
*A45D 40/12* (2006.01)

(52) U.S. Cl.
CPC ..... *A45D 40/02* (2013.01); *A45D 40/023* (2013.01); *A45D 40/06* (2013.01); *A45D 40/065* (2013.01); *A45D 40/12* (2013.01)

(58) Field of Classification Search
CPC ..... A45D 40/02; A45D 40/023; A45D 40/06; A45D 40/065; A45D 40/12
USPC ..... 401/55
See application file for complete search history.

(56) References Cited

U.S. PATENT DOCUMENTS 10,912,369 B2 * 2/2021 Presche ..... A45D 40/06
11,737,548 B2 * 8/2023 Mueller ..... A45D 40/04 401/78

* cited by examiner

*Primary Examiner* — Jennifer C Chiang
(74) *Attorney, Agent, or Firm* — Bruce Stone LLP; Joseph A. Bruce

(57) ABSTRACT

An easily recyclable cosmetic container includes a cylinder, a lining and a sleeve. The cylinder includes an outward flange and a shoulder. The lining includes two recesses and an annular ridge. The sleeve includes an inward flange, rectilinear ridges and an annular protuberance. The outward flange is inserted in one of the recesses and the shoulder is inserted in the remaining one of the recesses when the cylinder is inserted the lining. When the lining is inserted in the sleeve, an end of the lining is covered by the inward flange, the annular ridge is located against the annular protuberance, and the rectilinear ridges are in contact with the lining to prevent the lining from rotation relative to the sleeve.

9 Claims, 5 Drawing Sheets

RECYCLABLE COSMETIC CONTAINER

BACKGROUND OF INVENTION

1. Field of Invention

The present invention relates to cosmetic container and, more particularly, to an easily recyclable cosmetic container.

2. Related Prior Art

A container for a lipstick includes several layers of different materials. One of the layers can be made of a plastic material such as polyethylene terephthalate ("PET" or "PETE"). Another one of the layers can be made of metal. The layers are inserted in one another. Adhesive is used between any adjacent two of the layers to the keep the layers connected to one another in use. However, the use of the adhesive renders it extremely difficult if not impossible to detach the layers from one another so that they can be recycled separately according to their materials.

The present invention is therefore intended to obviate or at least alleviate the problems encountered in the prior art.

SUMMARY OF INVENTION

It is the primary objective of the present invention to provide an easily recyclable cosmetic container.

To achieve the foregoing objective, the easily recyclable cosmetic container includes a cylinder, a lining and a sleeve. The cylinder includes an outward flange and a shoulder. The lining includes two recesses and an annular ridge. The sleeve includes an inward flange, rectilinear ridges and an annular protuberance. The outward flange is inserted in one of the recesses and the shoulder is inserted in the remaining one of the recesses when the cylinder is inserted the lining. When the lining is inserted in the sleeve, an end of the lining is covered by the inward flange, the annular ridge is located against the annular protuberance, and the rectilinear ridges are in contact with the lining to prevent the lining from rotation relative to the sleeve.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
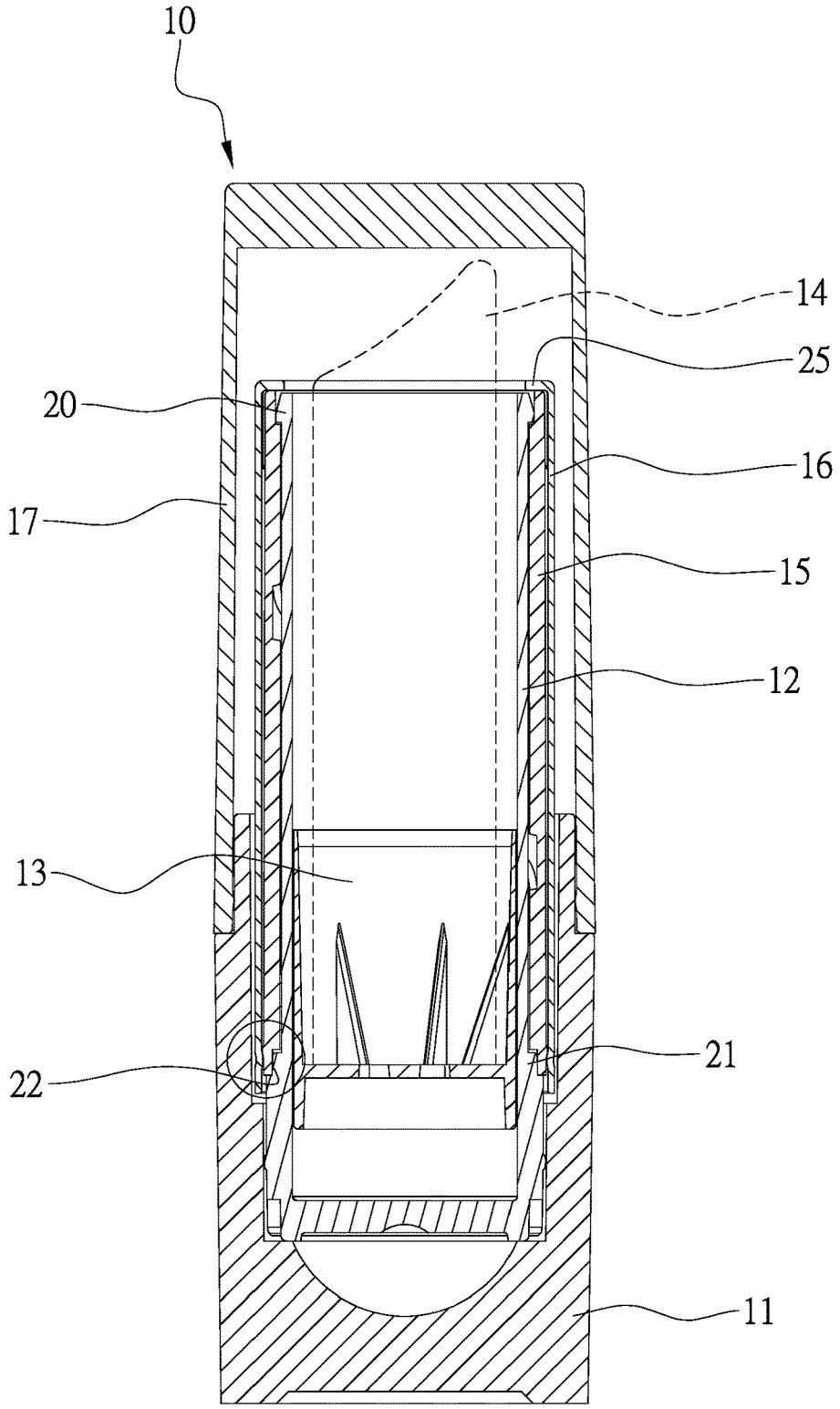
FIG. 1 is a cross-sectional view of a recyclable cosmetic container according to the preferred embodiment of the present invention.
Figure 2:
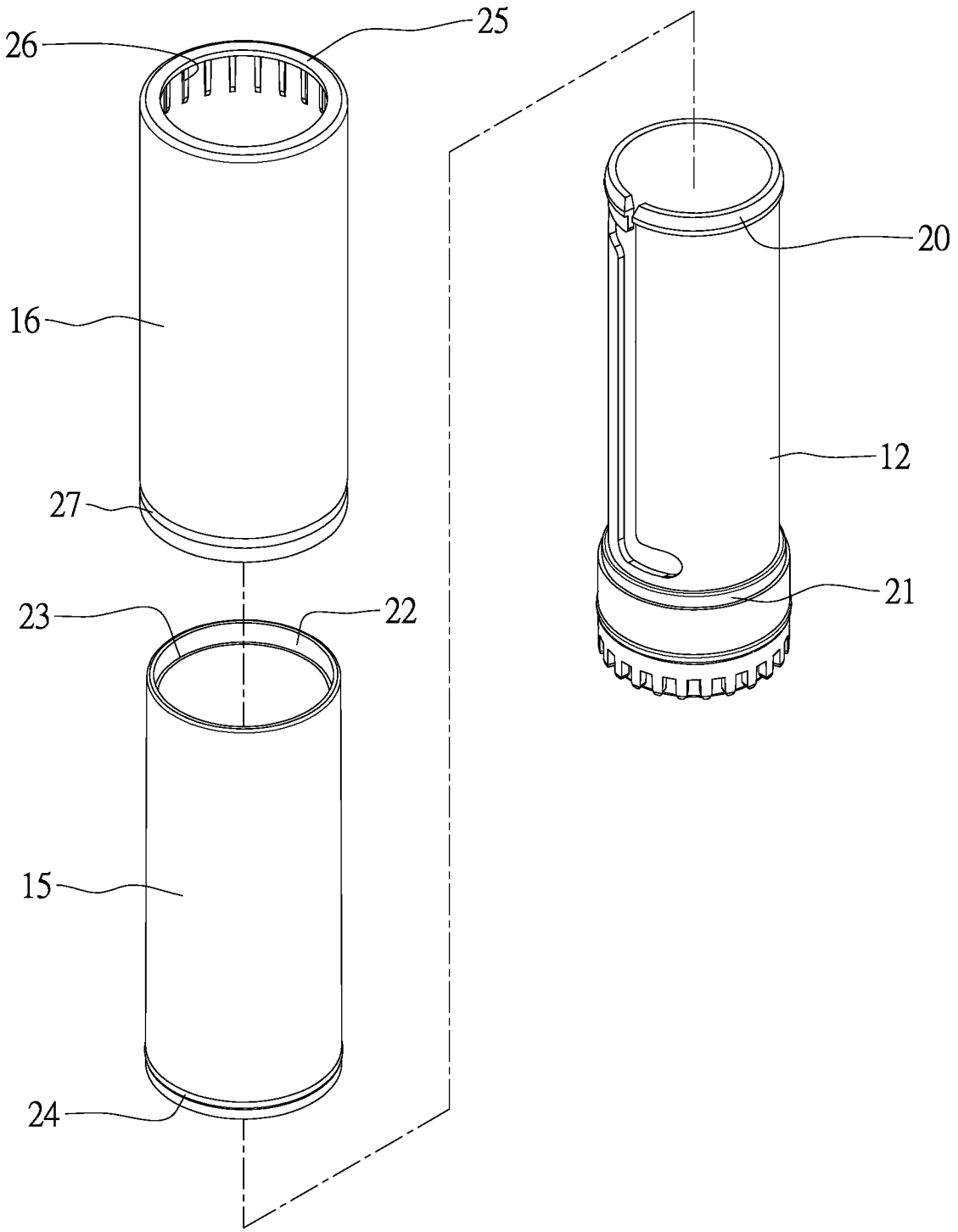
FIG. 2 is an exploded view of the recyclable cosmetic container shown in FIG. 1.

Referring to FIGS. 1 and 2, a cosmetic container 10 includes a handle 11, a cylinder 12, a cup 13, a lining 15, a sleeve 16, and a cap 17 according to the present invention. A lower section of a lipstick 14 is inserted in the cup 13. The cup 13 is movably inserted in the cylinder 12. The cylinder 12 is rotationally inserted in the lining 15. The lining 15 is inserted in the sleeve 16. A lower section of the sleeve 16 is inserted in the handle 11. The cup 13 is engaged with the handle 11 to cover the lipstick 14, the cup 13, the cylinder 12, the lining 15 and the sleeve 16 when the entire lipstick 14 is inserted in the cylinder 12. The cup 13 is disengaged from the handle 11 to allow the upper section of the lipstick 14 to extend from the cylinder 12.

As described above, the cylinder 12 is rotatable relative to the lining 15. The cylinder 12 and the lining 15 are made of polyethylene terephthalate ("PET" or "PETE") for example. The sleeve 16 is made of metal to adequately support the cylinder 12 and the lining 15. These elements are made separately and then connected to one another in use. It is however desirable to detach them from one another so that they can be recycled separately according to their materials. Hence, a mechanism is devised to connect these elements to one another in use and to allow they be detached from one another to be recycled.

The cylinder 12 includes an outward flange 20 and a shoulder 21. The outward flange 20 extends on an internal face of the cylinder 12, near an upper end. The shoulder 21 extends on the external face of the cylinder 12, near a lower end. Hence, there is a distance between the shoulder 21 and the outward flange 20.

Figure 4:
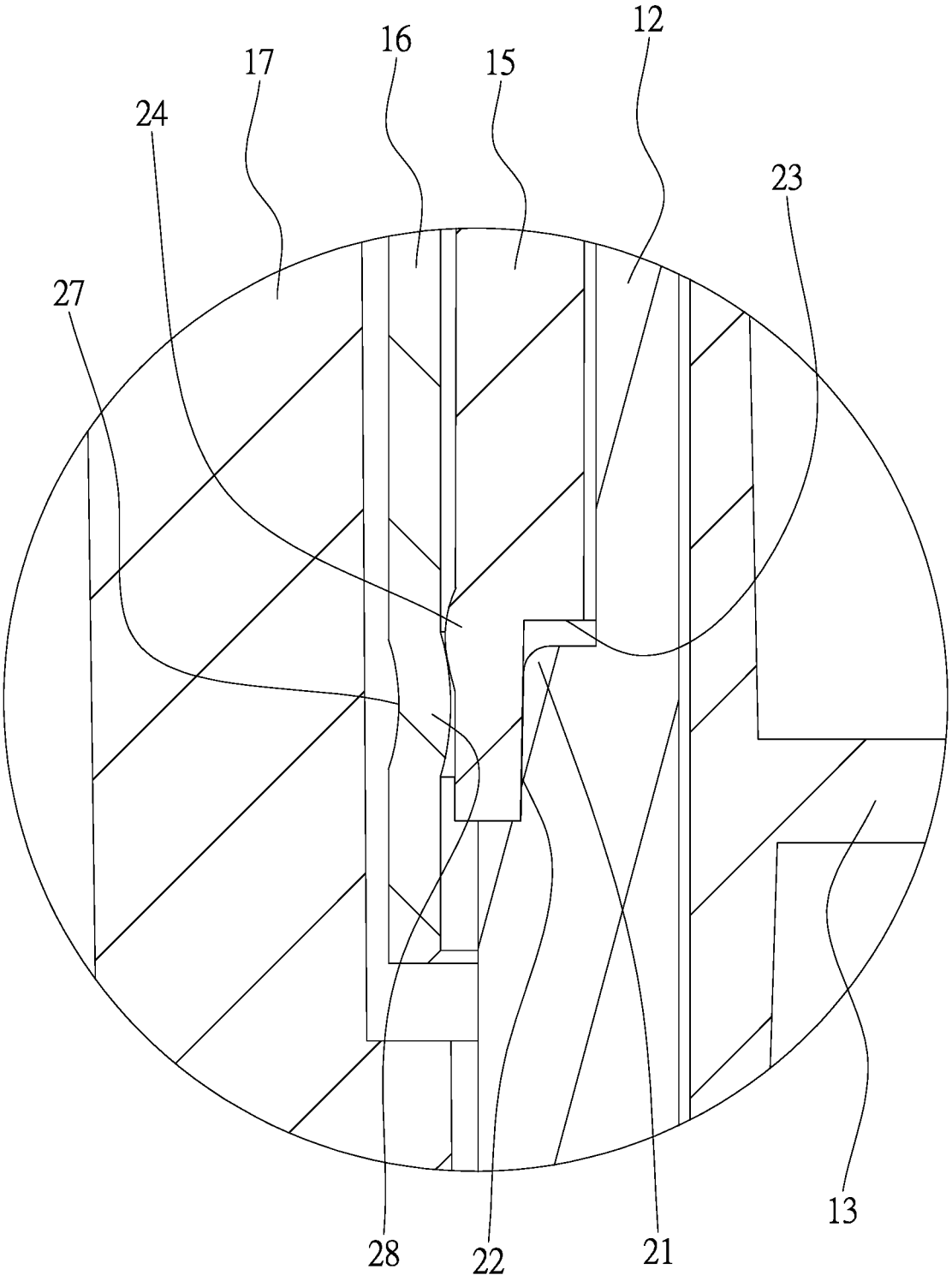
FIG. 4 is another enlarged partial view of the recyclable cosmetic container shown in FIG. 1.

The lining 15 includes two recesses 22, two shoulders 23, and an annular ridge 24. The recesses 22 are made in an internal face of the lining 15. One of the recesses 22 is located at an end of the lining 15. The remaining one of the recesses 22 is located at another end of the lining 15 (FIG. 4). Each the shoulders 23 is located next to a corresponding one of the recesses 22. The annular ridge 24 extends on an external face of the lining 15, near one of the ends.

The sleeve 16 includes an inward flange 25, rectilinear ridges 26, and a concave-convex section (not numbered). The inward flange 25 extends on an internal face of the sleeve 16, at an end. The rectilinear ridges 26 extend on the internal face of the sleeve 16 from the inward flange 25. The concave-convex section of the sleeve 16 includes an annular groove 27 in an external face of the sleeve 16 and an annular protuberance 28 on the internal face of the sleeve 16.

Figure 3:
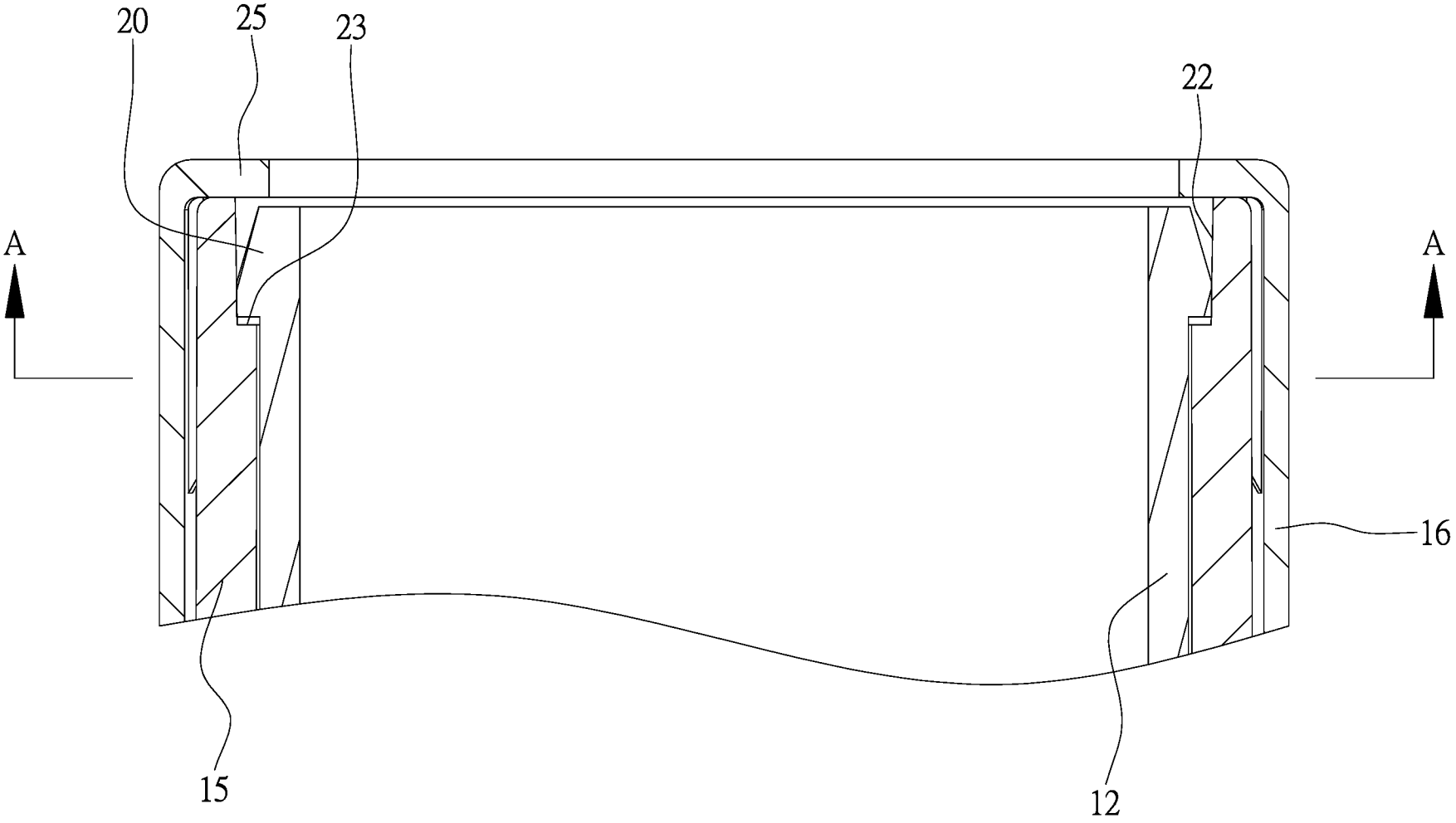
FIG. 3 is an enlarged partial view of the recyclable cosmetic container shown in FIG. 1.

Referring to FIGS. 3 and 4, when the cylinder 12 is inserted in the lining 15, the outward flange 20 is inserted in one of the recesses 22, and the shoulder 21 is inserted in the remaining one of the recesses 22. Thus, the outward flange 20 is located against one of the shoulders 23, and the shoulder 21 is inserted in the remaining one of the shoulders 23. Thus, the cylinder 12 is kept in the lining 15, i.e., the cylinder 12 is not translatable relative to the lining 15. However, the lining 15 is rotatable relative to the cylinder 12 as described above.

When the lining 15 is inserted in the sleeve 16, the inward flange 25 is located above one of the ends of the lining 15. Moreover, the annular protuberance 28 is located against the annular ridge 24. Thus, the lining 15 is not translatable relative to the sleeve 16.

Figure 5:
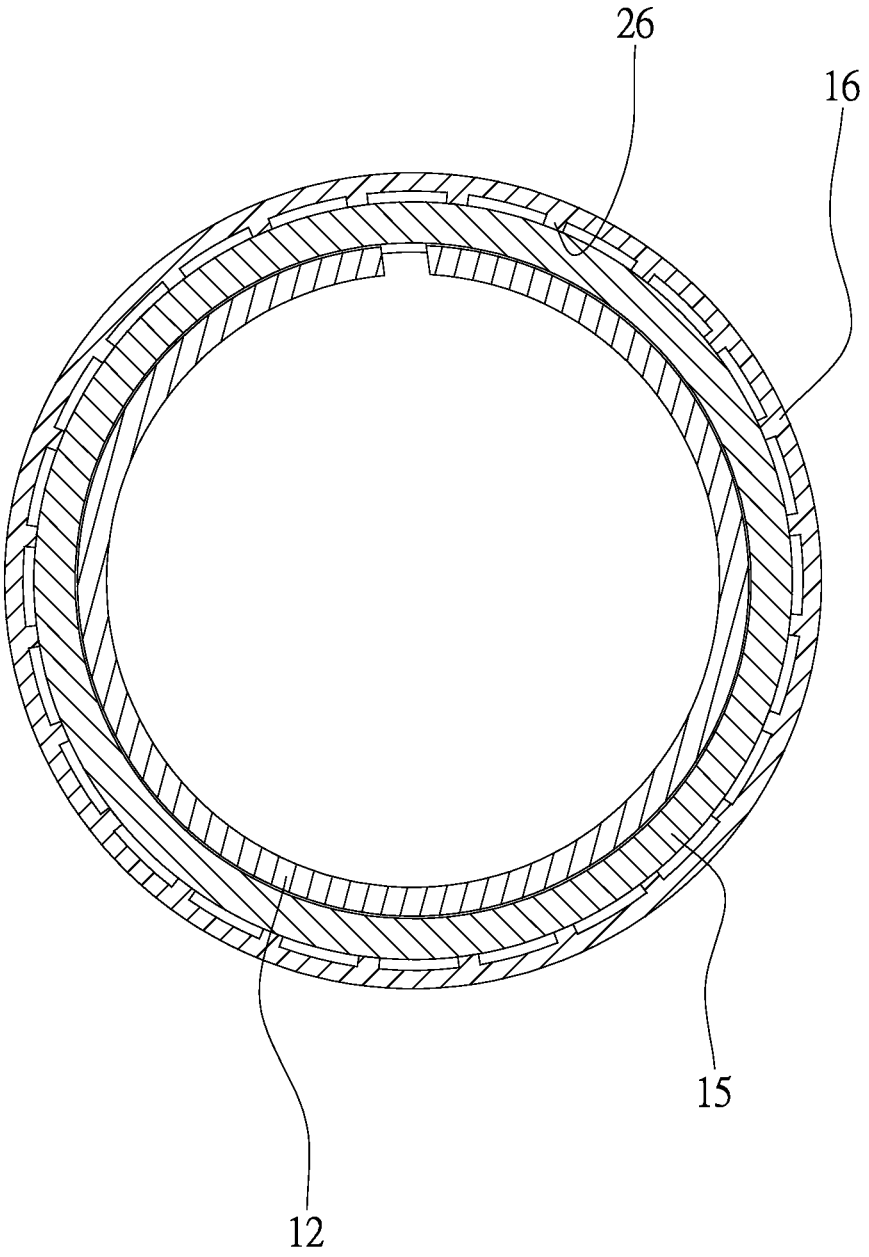
FIG. 5 is another cross-sectional view of the recyclable cosmetic container shown in FIG. 1.

Referring to FIG. 5, the rectilinear ridges 26 are located against the internal face of the lining 15. The friction between the rectilinear ridges 26 and the internal face of the lining 15 prevent the sleeve 16 from rotation relative to the lining 15.

As described above, it is easy to insert the cylinder 12, the lining 15 and the sleeve 16 in one another in use. It is easy to detach the cylinder 12, the lining 15 and the sleeve 16 from one another so that they can be recycled separately according to their materials. This is good for the protection of the environment.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. An easily recyclable cosmetic container comprising:

a cylinder comprising an outward flange and a shoulder;

a lining comprising two recesses and an annular ridge;

a sleeve comprising an inward flange, rectilinear ridges and an annular protuberance;

wherein the outward flange is inserted in one of the recesses and the shoulder is inserted in the remaining one of the recesses when the cylinder is inserted the lining; and wherein when the lining is inserted in the sleeve, an end of the lining is covered by the inward flange, the annular ridge is located against the annular protuberance, and the rectilinear ridges are in contact with the lining to prevent the lining from rotation relative to the sleeve.

2. The easily recyclable cosmetic container according to claim 1, wherein the lining comprises two shoulders next to the recesses respectively, and wherein the outward flange is located against one of the shoulders of lining and the shoulder of the cylinder is located against the remaining one of the shoulders of the lining when the outward flange is inserted in one of the recesses and the shoulder of the cylinder is inserted in the remaining one of the recesses.

3. The easily recyclable cosmetic container according to claim 1, wherein the sleeve comprises an annular groove in an external face to render the annular protuberance protrusive from an internal face of the sleeve.

4. The easily recyclable cosmetic container according to claim 1, wherein the rectilinear ridges extend from the inward flange on an internal face of the sleeve in a circle.

5. An easily recyclable cosmetic container comprising:

a cylinder comprising an outward flange and a shoulder;

a lining comprising two recesses and an annular ridge;

wherein the outward flange is inserted in one of the recesses and the shoulder is inserted in the remaining one of the recesses when the cylinder is inserted the lining.

6. The easily recyclable cosmetic container according to claim 5, wherein the lining comprises two shoulders next to the recesses respectively, and wherein the outward flange is located against one of the shoulders of lining and the shoulder of the cylinder is located against the remaining one of the shoulders of the lining when the outward flange is inserted in one of the recesses and the shoulder of the cylinder is inserted in the remaining one of the recesses.

7. An easily recyclable cosmetic container comprising:

a lining comprising an annular ridge;

a sleeve comprising an inward flange, rectilinear ridges and an annular protuberance;

wherein when the lining is inserted in the sleeve, an end of the lining is covered by the inward flange, the annular ridge is located against the annular protuberance, and the rectilinear ridges are in contact with the lining to prevent the lining from rotation relative to the sleeve.

8. The easily recyclable cosmetic container according to claim 7, wherein the sleeve comprises an annular groove in an external face to render the annular protuberance protrusive from an internal face of the sleeve.

9. The easily recyclable cosmetic container according to claim 7, wherein the rectilinear ridges extend from the inward flange on an internal face of the sleeve in a circle.

* * * * *